US005194302A

United States Patent [19]

Ruehl

[11] Patent Number: 5,194,302

[45] Date of Patent: Mar. 16, 1993

[54] MANUFACTURING METHOD FOR COATING VEHICLE STRUCTURAL FRAMES

[75] Inventor: Phillip C. Ruehl, Elm Grove, Wis.

[73] Assignee: A. O. Smith Corporation, Milwaukee, Wis.

[21] Appl. No.: 774,703

[22] Filed: Oct. 9, 1991

Related U.S. Application Data

[62] Division of Ser. No. 389,346, Aug. 3, 1989, Pat. No. 5,061,529.

[51] Int. Cl.[5] ..... B05D 3/12; B05D 1/18

[52] U.S. Cl. ..... 427/346; 427/430.1; 118/713; 118/423; 118/426; 118/428; 118/429

[58] Field of Search ..... 427/430.1, 346; 118/423, 426, 428, 429, 713

[56] References Cited

U.S. PATENT DOCUMENTS

| | | | |
|---|---|---|---|
| 2,073,576 | 3/1937 | Climenhaga | 141/1 |
| 2,116,430 | 5/1938 | Gordon | 214/17 |
| 2,119,720 | 6/1938 | Reifsnyder . | |
| 2,417,472 | 3/1947 | Dorff | 118/426 |
| 2,482,269 | 9/1949 | Grimes | 118/425 |
| 2,552,612 | 5/1951 | Adams et al. . | |
| 2,570,746 | 10/1951 | Bablik | 91/12.6 |
| 2,658,008 | 11/1953 | Williams et al. . | |
| 2,728,686 | 12/1955 | Borushko . | |
| 2,852,410 | 9/1958 | Brewer . | |
| 2,862,236 | 12/1958 | Shapero . | |
| 2,872,893 | 2/1959 | Kling | 118/10 |
| 2,944,655 | 7/1960 | Griswold . | |
| 3,056,372 | 10/1962 | Bassett et al. . | |
| 3,110,627 | 11/1963 | Weiskopf et al. . | |
| 3,183,818 | 5/1965 | Pangborn et al. . | |
| 3,429,358 | 2/1969 | Tingquist | 118/426 |
| 3,472,203 | 10/1969 | Coleman . | |
| 4,407,225 | 10/1983 | Kataishi et al. | 118/425 |
| 4,408,560 | 10/1983 | Caratsch | 118/69 |
| 4,473,604 | 9/1984 | Rolle et al. | 427/444 |
| 4,485,761 | 12/1984 | Stewart | 118/426 |
| 4,502,410 | 3/1985 | Donahue | 118/429 |
| 4,560,592 | 12/1985 | Friedland | 427/430.1 |
| 4,834,019 | 5/1989 | Gordon et al. | 118/423 |

FOREIGN PATENT DOCUMENTS

| | | |
|---|---|---|
| 443689 | 1/1942 | Belgium . |
| 2603211 | 8/1987 | France . |
| 60-18925 | 1/1985 | Japan . |

*Primary Examiner*—Shrive Beck
*Assistant Examiner*—Katherine A. Bareford
*Attorney, Agent, or Firm*—Andrus, Sceales, Starke & Sawall

[57] ABSTRACT

A manufacturing facility (20) has substantially reduced space requirements for applying a coating to vehicle structural components such as frames (22, 24). A rotary carousel (28) in a building (26) has a central hub (30) rotatable about a vertical axis and has one or more arms (32) thereon swingable about pivot points (60) on the hub to lower and raise the frames. A loading station (36), preheat wash station (46), rinse station (48), coating station (38), post heat drip station (50) and unloading station (44) are peripherally spaced around the hub such that rotation of the hub moves the arms between the stations for respective functions.

11 Claims, 9 Drawing Sheets

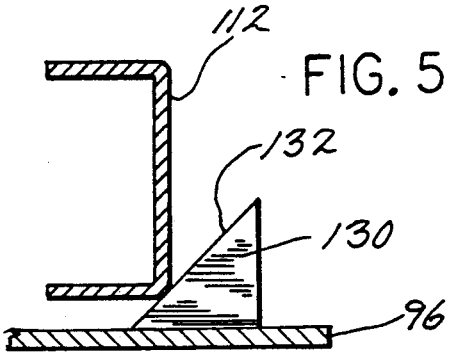
FIG. 5
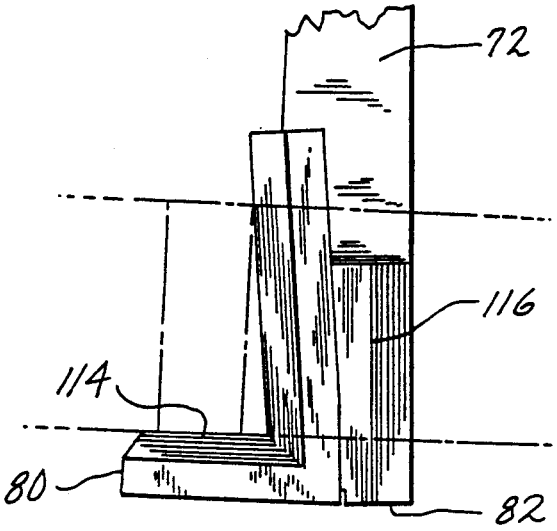
FIG. 6
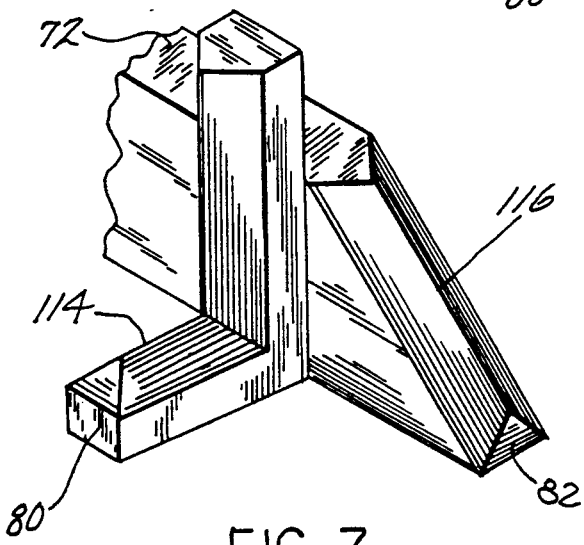
FIG. 7
FIG. 12
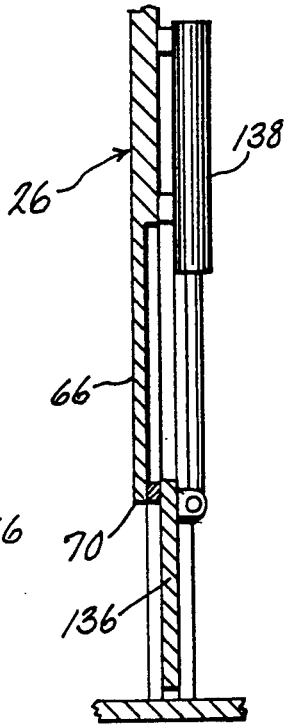
FIG. 11
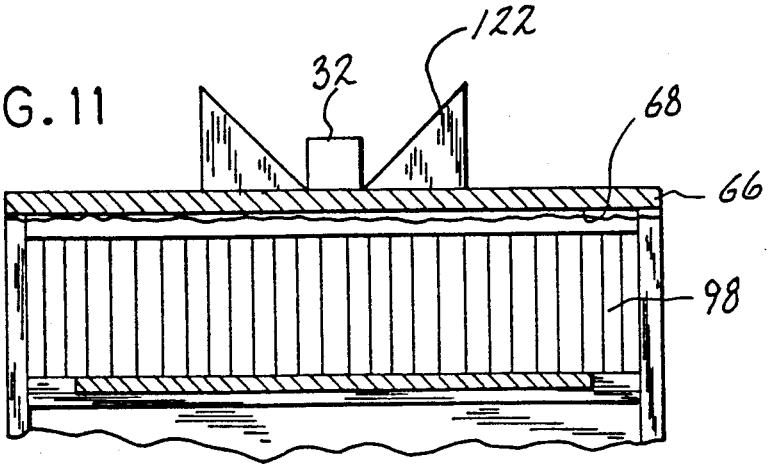

FIG. 8
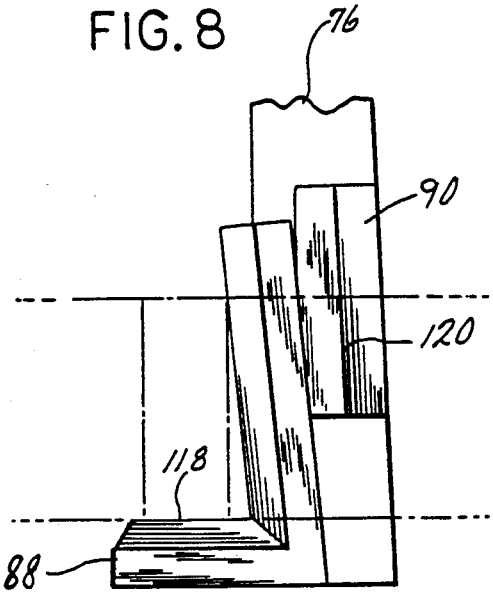
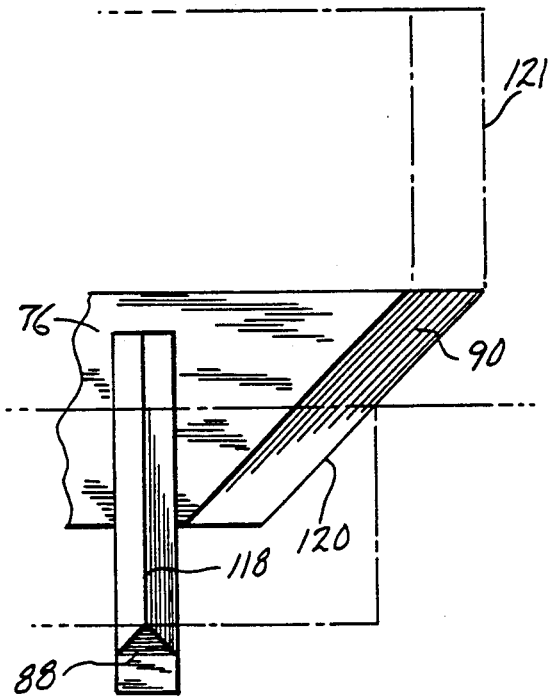
FIG. 9
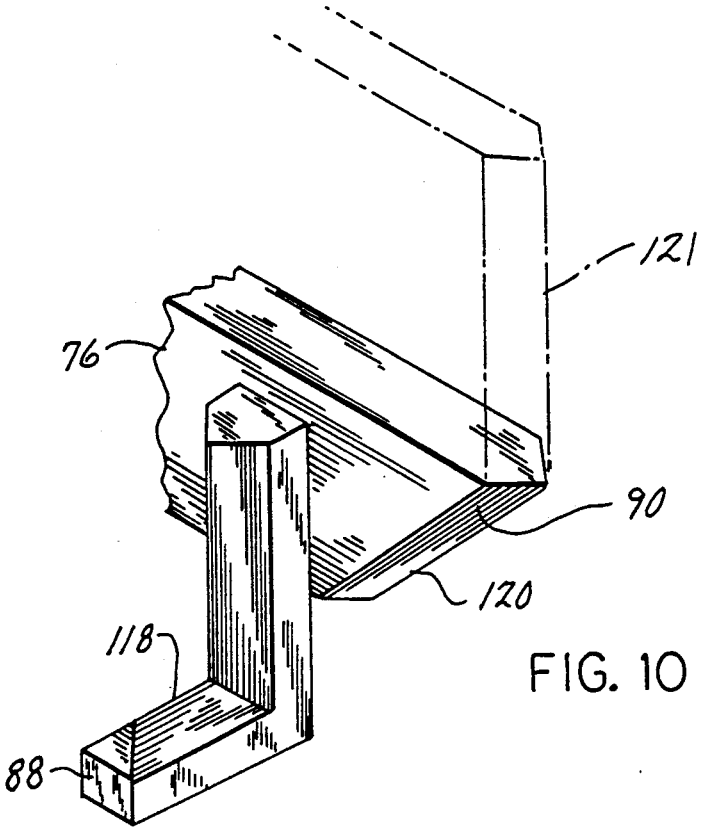
FIG. 10

MANUFACTURING METHOD FOR COATING VEHICLE STRUCTURAL FRAMES

This is a division of application Ser. No. 07/389,346, filed Aug. 3, 1989, now U.S. Pat. No. 5,061,529.

BACKGROUND AND SUMMARY

The present invention relates to manufacturing methods and facilities for applying a coating to vehicle structural components, including the application of a hot melt wax coating to vehicle frames for protection against rust and corrosion.

The present invention arose during development efforts directed toward reducing the high capital expense of a manufacturing facility for coating vehicle structural components such as frames. Vehicle manufacturers are more commonly requiring vendors and parts suppliers to have local on-site manufacturing or processing facilities coordinating with the assembly operation of the vehicle manufacturer. In the case of suppliers providing vehicle structural components such as frames, this requires erection of a coating facility at each of the various satellite assembly facilities. However, erection of multiple satellite coating facilities is not cost effective due to the extremely high capital expense of same.

A vehicle frame is a generally flat longitudinal structural member which in one exemplary size has a longitudinal length of about 178 inches, a lateral width of about 42 inches, and a height of about 16 inches, though the dimensions may of course vary. Prior facilities for applying a hot melt wax coating to such frames typically require buildings of about 2 million cubic feet, with 50,000 square feet of lateral area and over 60 feet in height. The frames are hung vertically and transported to a dipping tank and dipped downwardly into the tank for coating the frame in the hot melt wax liquid, and then raised out of the tank. Hence, the building must be at least twice as high as the longitudinal length of the frame. The tank volume is about 63,000 gallons. The building is heated by ovens or the like such that the heated air in the building preheats the frames prior to dipping, to enhance the coating during the dip into the hot melt wax liquid tank. Preheating of the frames with air is inefficient and requires long preheat times. The vertical hanging of the frames also requires large openings into and out of the building, causing significant heat loss and energy inefficiency. The construction cost of the building is high because of its special requirements. Furthermore, the building has no other use.

The present invention addresses and solves the above noted problems with a simple and effective manufacturing method and facility. The invention reduces the building volume by a factor of 10 or more, e.g. the new building can be reduced to as little as 5% of the volume of the prior building. The invention also reduces the tank volume requirements for the coating liquid to as little as 4%, e.g. to as low as 2,000 gallons instead of the 63,000 gallons required for the above noted prior tank. This saves wax cost. The invention also significantly reduces the height requirement of the tank, e.g. from about 25 feet deep to about 25 inches deep. This desirably solves problems of hydrostatic fluid pressure and leakaqe caused thereby at the bottom of the tank. The construction cost of the building is reduced by a factor of about 10 due to the reduced special requirements of the building and also due to reduced loading capability of the building due to special transport structure within the building in accordance with the invention for carrying the vehicle structural components. The building is adaptable to other uses in the event of changing requirements. The transport mechanism and core within the building can be moved to other buildings and locations.

BRIEF DESCRIPTION OF THE DRAWINGS

FIG. 5 is a sectional view taken along line 5—5 of FIG. 4.

FIG. 6 is an enlarged view of a portion of the structure in FIG. 4.

FIG. 7 is a perspective view of the structure of FIG. 6.

FIG. 8 is an enlarged view of a portion of the structure in FIG. 4.

FIG. 9 is an end view of the structure in FIG. 8.

FIG. 10 is a perspective view of the structure in FIG. 8.

FIG. 11 is a sectional view taken along line 11—11 of FIG. 4.

FIG. 12 is a sectional view taken along line 12—12 of FIG. 1.

DETAILED DESCRIPTION

Figure 1:
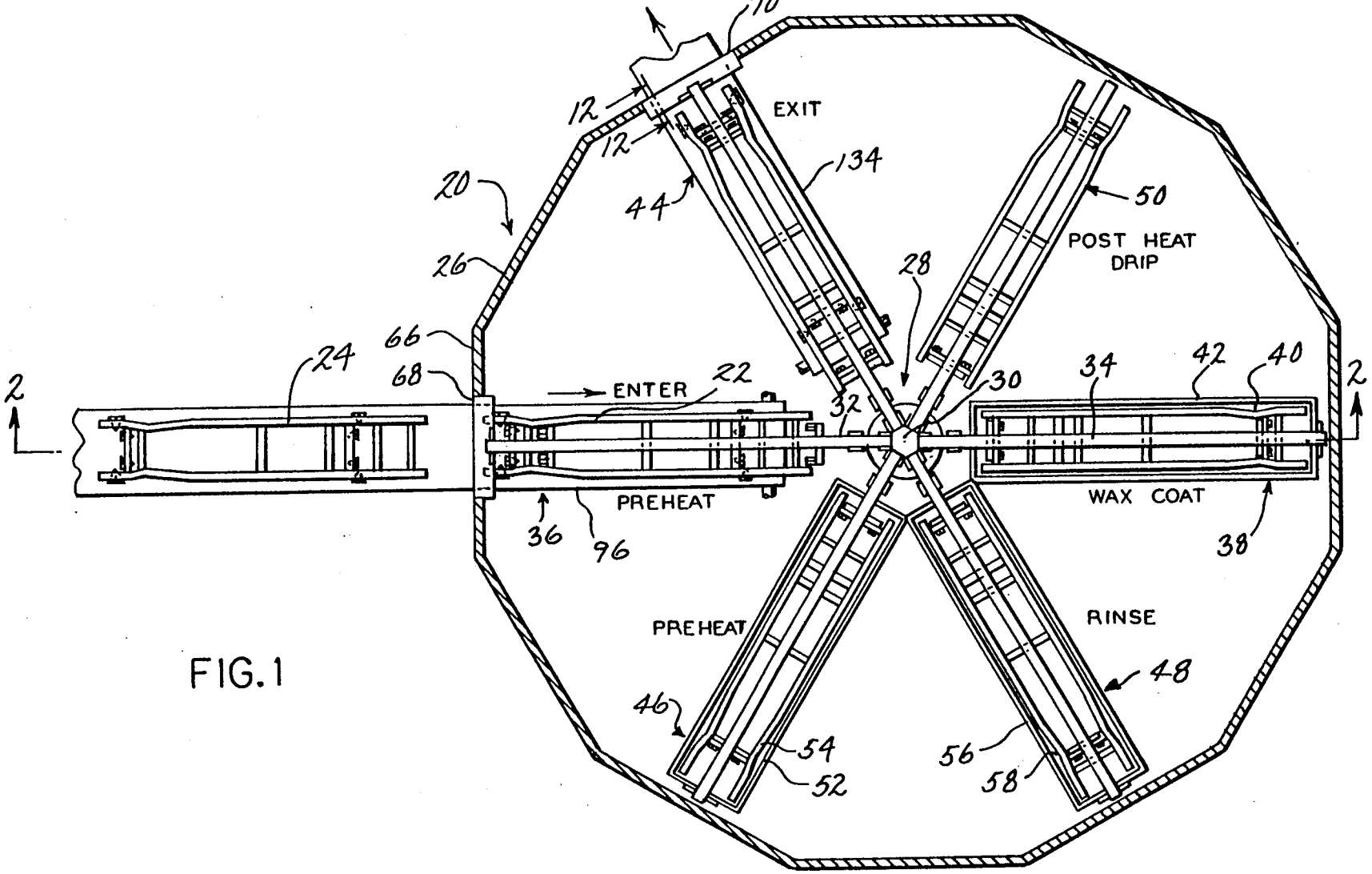
FIG. 1 is a top view of a manufacturing facility constructed in accordance with the invention.

FIG. 1 shows a manufacturing facility 20 with substantially reduced space requirements for applying a coating to vehicle structural components such as frames 22, 24, and the like. The facility includes a building 26 housing a central rotary carousel 28 having a central hub 30 rotatable about a vertical axis and having a plurality of arms 32, 34, etc. thereon. Building 26 also houses a loading station 36, a coating station 38 having coating liquid 40 in tank 42, and an unloading station 44, all spaced peripherally around hub 30 such that rotation of hub 30 moves the arms to the various stations. Building 26 also houses a preheat wash station 46, a rinse station 48, and a post heat drip station 50. Preheat wash station 46 includes a tank 52 with a wash liquid 54 at an elevated temperature. Rinse station 48 includes a tank 56 with a rinse liquid 58 at an elevated temperature. The preheat wash and rinse stations preheat the frame by liquid heat transfer, to enhance the hot melt wax coating at station 38 when the frame is dipped into the hot melt wax coating liquid 40, to be described.

Counterclockwise rotation of hub 30 moves arm 32 to loading station 36 as shown in FIG. 1, for attaching frame 22 to arm 32, to be described. Further counterclockwise rotation of hub 30 moves arm 32 to preheat wash station 46, and then to rinse station 48, and then to coating station 38, and then to post heat drip station 50, and then to unloading station 44 for detaching frame 44 from the arm.

Figure 2:
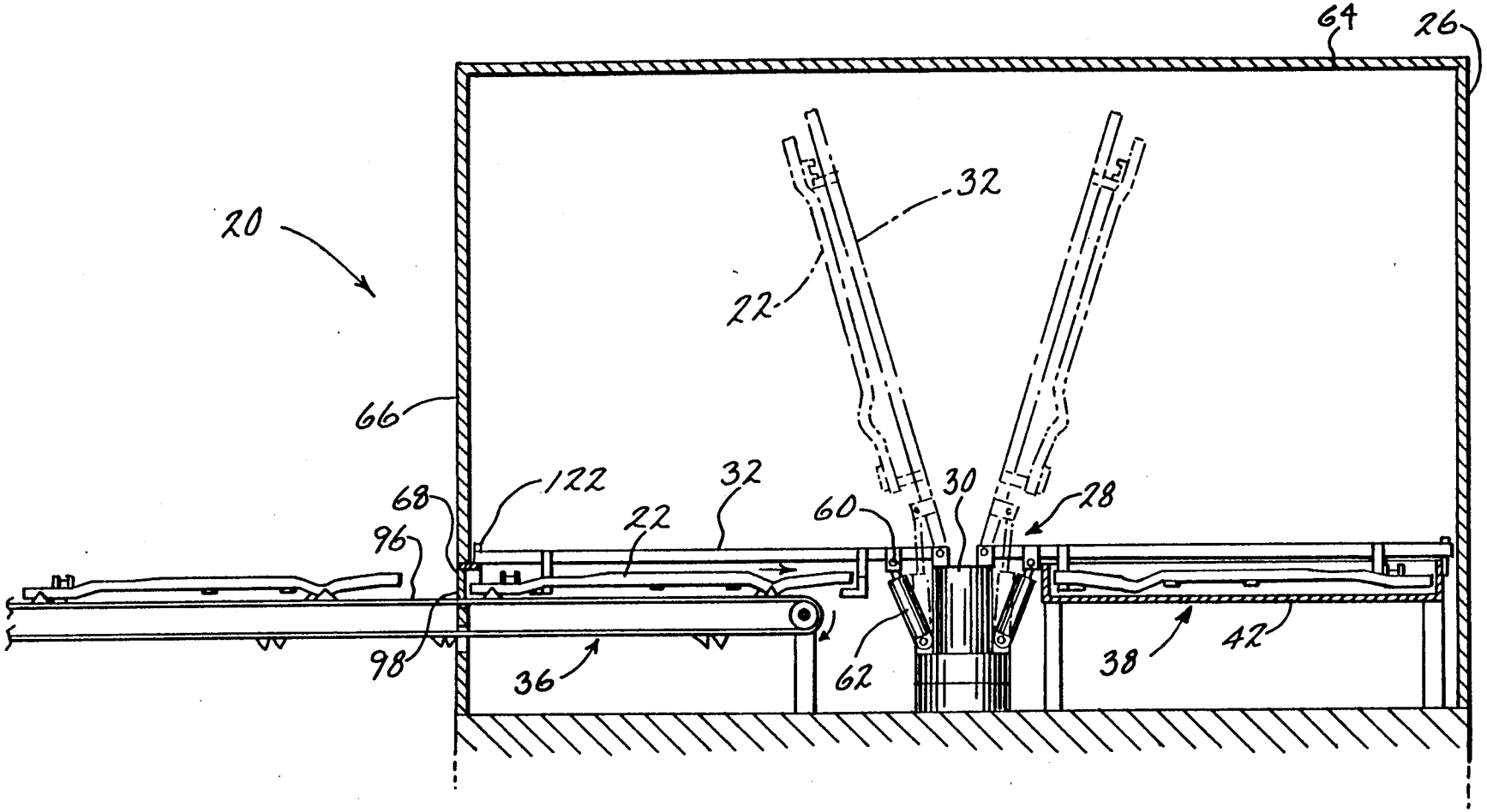
FIG. 2 is a sectional view taken along line 2—2 of FIG. 1.

Arm 32 moves downwardly, FIG. 2, at loading station 36 to engage frame 22 and then moves upwardly to lift the frame and carry the frame during rotation of hub 30. The arm moves downwardly at each of stations 46, 48 and 38 to lower the frame into the liquid in the respective tank, and then moves upwardly to raise the frame out of such liquid in the respective tank. The arm moves downwardly at unloading station 44 to disengage the frame and then moves upwardly and rotates to loading station 36, to begin the next cycle.

Arm 32 swings in an arc about pivot point 60 at hub 30, and is actuated between its upwardly raised position as shown in phantom line and its downwardly lowered position as shown in solid line by a hydraulic cylinder 62, or alternatively is pneumatically actuated, or is raised and lowered by a cable, chain, or the like. Frame 22 at loading station 36 is attached in a generally horizontal position to arm 32. The frame is likewise detached in a generally horizontal position from the arm at unloading station 44. The frame is lowered by the arm into the respective tanks at stations 46, 48 and 38 in a generally horizontal position in the respective tank. The horizontal loading, dipped and unloading positions of the frame are all substantially coplanar.

Frame 22 has a longitudinal extent of a given length. As seen in FIG. 2, building 26 has a height to roof 64 substantially less than twice the length of frame 22. The transport mechanism provided by carousel 28 moves frame 22 through stations 36, 46, 48, 38 and 44 such that the longitudinal extent of frame 22 is substantially horizontal. The raising and lowering of frame 22 into and out of the tanks at stations 46, 48 and 38 defines a travel path having a vertical height substantially less than twice the length of the frame. Building 26 has a sidewall 66 with an entrance opening 68 therethrough, FIGS. 1, 2 and 11, at loading station 36, and an exit opening 70 therethrough at unloading station 44. Frame 22 is passed longitudinally through such openings in a generally horizontal position into and out of building 26, such that openings 68 and 70 have minimum dimensions, to minimize heat loss from the building.

At drip station 50, uncoated excess liquid is allowed to drip from the frame. Additionally or alternatively, uncoated excess liquid is allowed to drip from the frame above tank 42 at coating station 38. The amount of pivoting of the transport arm varies the tilt angle, to provide an adjustable drip angle of the frame. This is particularly desirable because it enables a selectively chosen drip angle, which in some instances may be vertical, or in other instances at a diagonal angle relative to horizontal. The latter is preferred to prevent drips from one of the lateral cross pieces of the frame from dripping onto another lateral cross piece therebelow. The pivoted transport arm thus moves the frame through the coating station into and out of contact with the coating liquid and raises the frame after such coating to a tilted position such that the longitudinal extent of the frame is tilted at an angle relative to horizontal.

Figure 3:
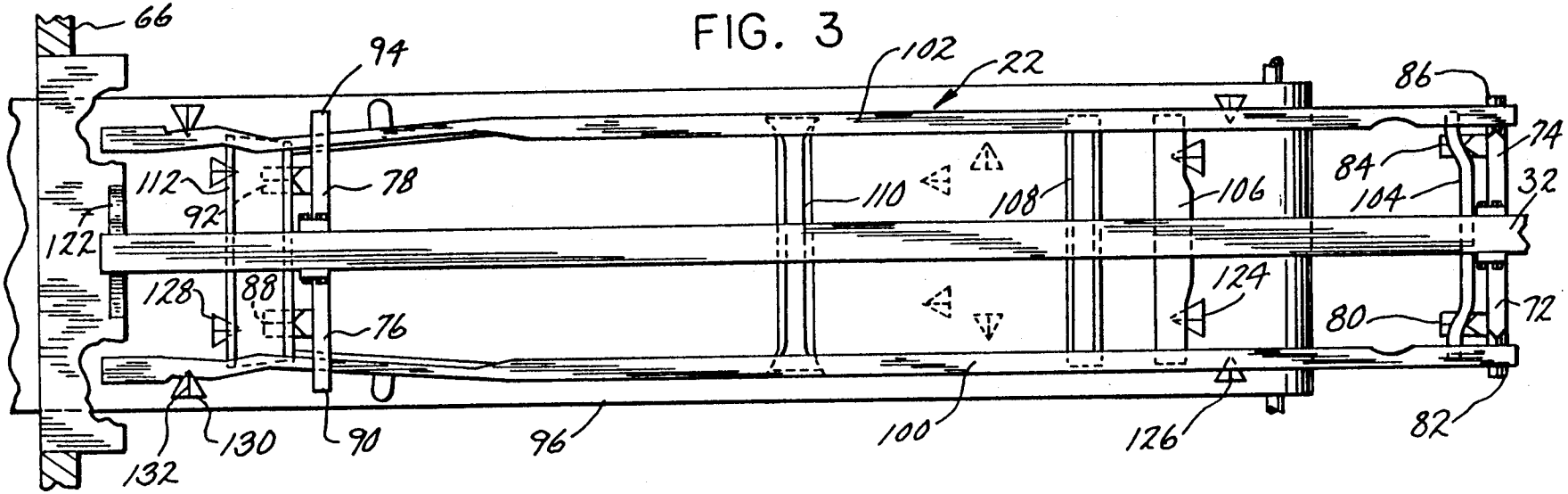
FIG. 3 is an enlarged top view of a portion of the structure in FIG. 1.
Figure 4:
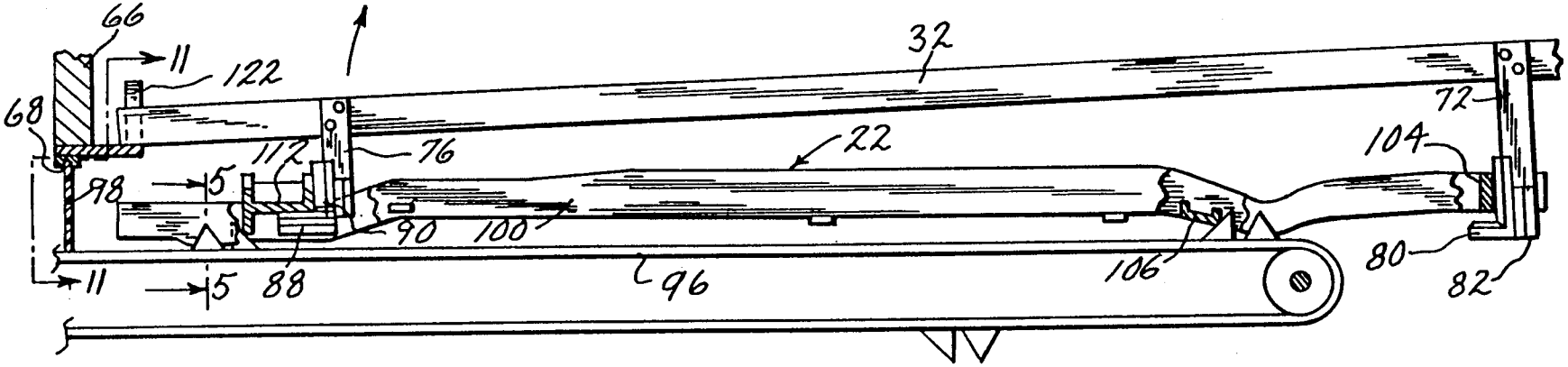
FIG. 4 is a side view of the structure in FIG. 3.

Hands 72, 74, 76, 78, FIGS. 3 and 4, extend from arm 32 and have fingers 80, 82, 84, 86, 88, 90, 92, 94 engaging frame 22. Frame 22 is attached to the fingers at loading station 36. A conveyance mechanism provided by continuous belt conveyor 96 carries frame 22 longitudinally horizontally through flexible hanging leaves 98 at opening 68 in building wall 66 to loading station 36. Conveyor 96 carries frame 22 rightwardly, FIGS. 1–4, to a first position. Arm 32 is swung downwardly, with at least some of the noted fingers moving downwardly past and below frame 22. Conveyor 96 then carries frame 22 further rightwardly, advancing frame 22 to a second position above the last mentioned fingers, such that upon swinging arm 32 upwardly, such last mentioned fingers engage the underside of frame 22 and lift same.

Frame 22 is a generally flat planar member having a pair of longitudinal sides 100 and 102, FIG. 3, and a plurality of lateral cross pieces such as 104, 106, 108, 110, 112. Fingers 80 and 84 engage the underside of cross piece 104. Fingers 82 and 86 engage the underside of longitudinal sides 100 and 102, respectively. Fingers 88 and 92 engage the underside of cross piece 112. Fingers 90 and 94 engage the top side of longitudinal sides 100 and 102, respectively. The noted engagement locates the longitudinal sides of the frame and the respective cross pieces of the frame, to precisely locate the frame both longitudinally and laterally.

The fingers are formed with a knife edge laterally crossing the respective portion of the frame, for example as shown at knife edges 114 and 116 for respective fingers 80 and 82 in FIGS. 6 and 7, and knife edges 118 and 120 for respective fingers 88 and 90 in FIGS. 8–10. The lower fingers 80, 84, 88, 92 are slightly angled, such that when arm 32 is in the lowered position, the lower fingers tilt upwardly leftwardly and engage only an edge of the frame to provide only point contact therewith, to enhance the coating of the frame. The lateral lower fingers 82 and 86 and the lateral upper fingers 90 and 94 extend laterally across the longitudinal sides of the frame and are likewise angled, as shown in FIGS. 7 for finger 82, and in FIGS. 9 and 10 for finger 90, to also provide only point contact with the frame, to enhance coating of the frame. The noted lower longitudinal fingers are tilted sufficiently relative to the respective hands such that arm 32 may be lowered to a position slightly beyond horizontal, FIG. 4, and the lower fingers will still engage and lift frame 22. In a further embodiment, finger 90 has an upwardly extending portion 121 facilitating stacking of frames. In this latter embodiment, two or more frames are carried on carousel arm 32, such that two or more frames are dipped during each dipping step, etc. In this embodiment, edge 120 does not engage the top of the frame therebelow, but rather locates the siderails of the frame outboard thereof, and edge 121 is spaced slightly inwardly of the frame siderail.

Stationary V-shaped structure 122, FIG. 11, is provided at loading station 36 and spaced above conveyor 96 and is engaged by arm 32 during downward swinging of the arm to guide and locate the arm relative to conveyor 96 and frame 22. Conveyor 96 has a plurality of cones 124, 126, 128, 130, etc., thereon, with angled bevel surfaces forming knife edges such as 132, FIGS. 3 and 5, which extend along a diagonal angle to provide point contact with the frame. Some of the cones such as cones 126 and 130 engage the longitudinal sides of the frame, and others of the cones such as cones 124 and 128 engage lateral cross pieces of the frame. The cones space the frame above conveyor 96 and precisely locate the frame both longitudinally and laterally. In an alternate embodiment, the frame has a plurality of holes in the underside thereof, and conveyor 96 has a plurality of cones extending upwardly partially through such holes and spacing the frame above the conveyor and precisely locating the frame both longitudinally and laterally.

Unloading at station 44 is comparable but reversed in sequence from loading at station 36. A conveyor 134 is provided like conveyor 96. The transport arm of the carousel is lowered to lower the frame onto the cones on the conveyor. The above noted knife edges and angles on the fingers provide the noted point contact with the frame and minimize marring of the coating on the frame. In most applications, there is no marring because the hot melt wax coating heals itself, which healing is facilitated by the noted point contact, which minimizes the area which must be healed by continued flow of the hot melt wax coating after disengagement of the frame by the fingers. The above noted beveled surfaces and knife edges such as 132, FIG. 5, of the cones on the conveyor and the angles thereof desirably provide only point contact with the coated frame on exit conveyor 134. After the pivot arm of the carousel is lowered such that the frame now rests on the cones on conveyor 134, the latter moves slightly to partially advance the frame to allow clearance of the lower fingers, and the pivot arm is then raised upwardly, whereafter conveyor 134 carries the frame outwardly through opening 70 of the building. Opening 70 is not provided with the hanging flexible leaves such as 98 of entrance opening 68, because such leaves would drag across and mar the coating on the frame. Instead, opening 70 is provided with a quick acting guillotine door 136, FIG. 12, actuated by pneumatic cylinder 138 to quickly move vertically upwardly and downwardly. This minimizes heat loss from the building.

Figure 13:
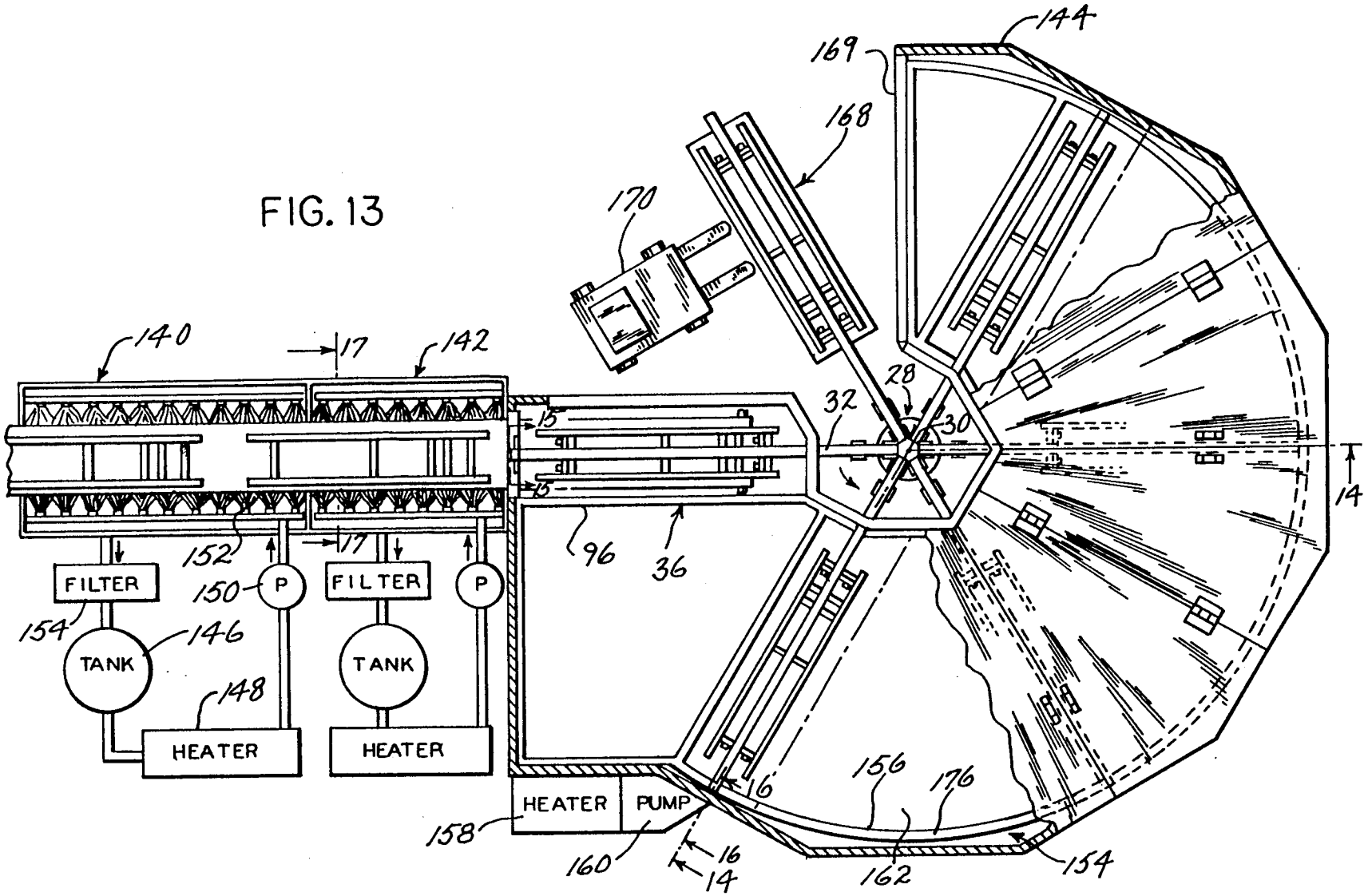
FIG. 13 is a top view of an alternate embodiment of a manufacturing facility constructed in accordance with the invention.
Figure 16:
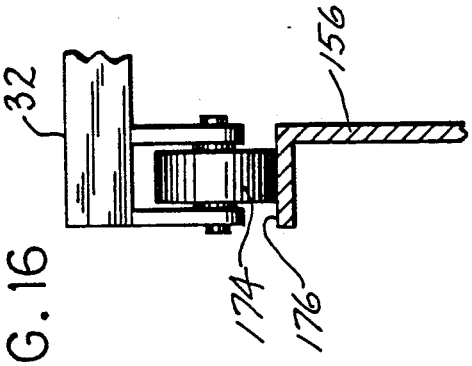
FIG. 16 is a sectional view taken along line 16—16 of FIG. 13.

FIG. 13 shows a further embodiment, and like reference numerals are used from the above FIGS. where appropriate to facilitate clarity. Preheat wash and rinse stations 140 and 142 are external of building 144. Preheat wash station 140 includes a tank 146, a heater 148, a pump 150 supplying heated wash liquid to spray nozzles 152, and a return filter 154. Rinse station 142 is comparable for rinse liquid. Conveyor 96 conveys the frame horizontally longitudinally through stations 140 and 142 to provide liquid heat transfer to the frame, and then moves the frame into building 144. This movement is along the direction of the longitudinal extent of the frame. The frame is attached to pivot arm 32 as above described, and the arm swings upwardly to lift the frame from conveyor 96.

Coating station 38 of FIG. 1 is replaced by a coating station 154 in FIG. 13 with a tank 156 which is substantially laterally expanded to extend along a significant portion of the inner periphery of the building around hub 30. In FIG. 13, tank 156 has a semicircular shape when viewed from above. Transport arm 32 lowers the frame into and out of tank 156, as above. Transport arm 32 also moves the frame horizontally through tank 156 in a direction transverse to the longitudinal extent of the frame. The lowering and raising of the frame into and out of the tank defines a travel path having a vertical height substantially less than twice the length of the frame, as before. A heater 158 and pump 160 are provided for heating and pumping coating liquid 162 to tank 156.

Figure 14:
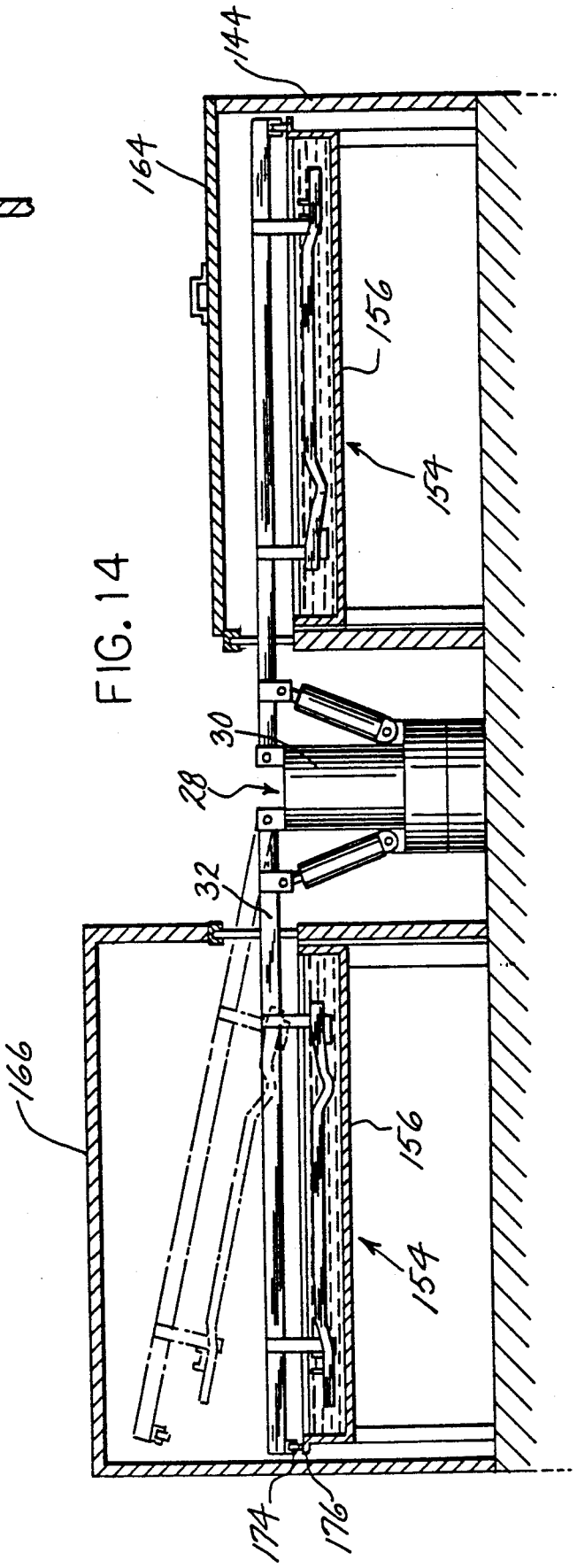
FIG. 14 is a sectional view taken along line 14—14 of FIG. 13.

Building 144 has differing heights at loading station 36 and the central portion of coating station 154. At loading station 136, the building must be high enough to allow arm 32 to pivot upwardly to lift the frame from conveyor 96. However, in the central portion of coating station 154, as shown on the right side of FIG. 14, arm 32 need only move horizontally laterally, and hence there is no need for any greater building height other than a small clearance for arm 32 above the tank. The roof of building 144 along this central portion of coating station 154 is provided by access doors 164. At the beginning of coating station 154, an increased building height is necessary as shown at roof 166 at the left side of FIG. 14, to accommodate movement of arm 32 in an upward position over tank 156 and then downward movement of arm 32 to lower the frame into tank 156. The building likewise has a higher roof at the end of coating section 154. The building thus has a first lower height at roof access door 164 over the middle of tank 156, and second higher heights as at roof 166 at the ends of the tank to permit downward and upward swinging of arm 32 to lower and raise the frame into and out of the tank. The unloading station may be provided within the building, as in FIG. 1, or an external loading station 168 may be provided with the frames remaining in a horizontal position but stacked vertically, and then periodically removed by a forklift 170 or the like. Building 144 has an external recess 169 formed in the periphery thereof at which unloading station 168 is located.

Figure 15:
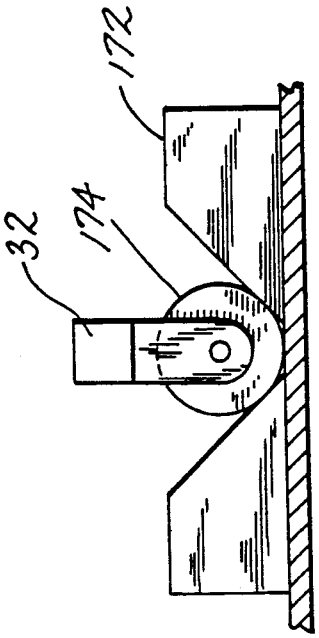
FIG. 15 is a sectional view taken along line 15—15 of FIG. 13.

In a further embodiment, a cam track is provided in the building to assist or eliminate the pivot arm actuators such as 62. FIG. 15 shows a cam track 172 extending at least partially peripherally around central hub 30. Arm 32 has a roller 174 engaging and rolling along the cam track during rotation of hub 30 such that arm 32 is lowered and raised according to the camming profile of the cam track. The cam track has a V-shape at loading station 136 such that roller 174 rides down the V to lower the arm to engage the frame. At coating station 154, the cam track may be provided by the upper lip 176 of the tank having high lobes at the beginning and the end of the tank, and having an extended low lobe along the central portion of the tank. The horizontal circumferential length of the low lobe portion of the cam surface controls the length of horizontal travel of the frame in coating liquid 162 in tank 156 during rotation of hub 30, to control coating of the frame.

Figure 18:
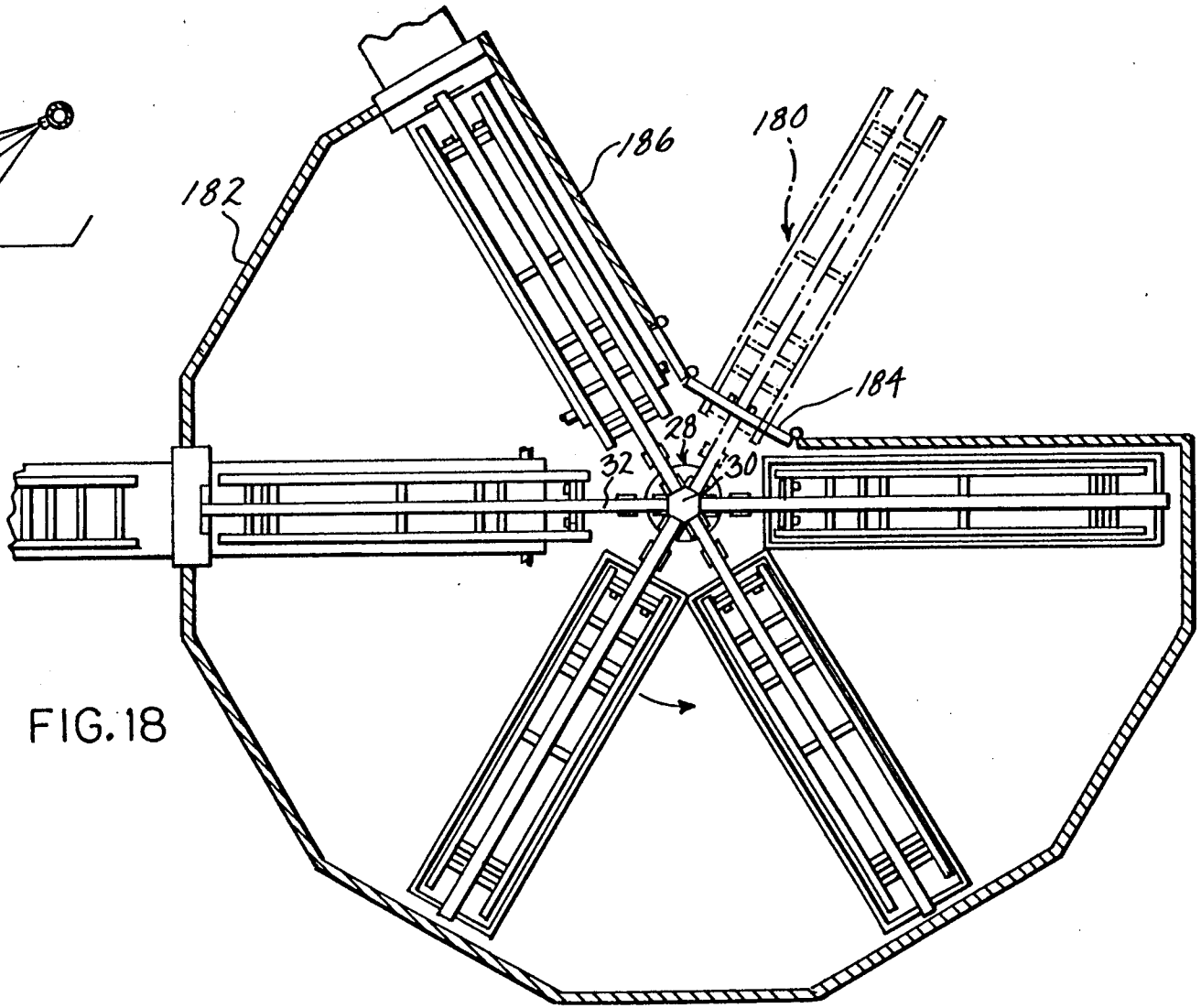
FIG. 18 is a top view of another embodiment of a manufacturing facility constructed in accordance with the invention.
Figure 17:
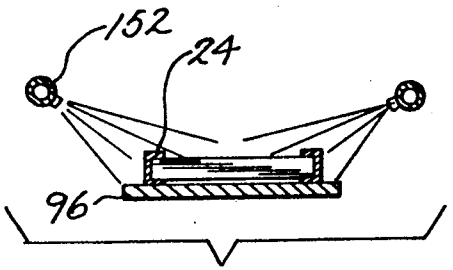
FIG. 17 is a sectional view taken along line 17—17 of FIG. 13.

FIG. 18 shows another embodiment, and uses like reference numerals from the above FIGS. where appropriate to facilitate clarity. A servicing station 180 is spaced along the periphery of hub 30. Building 182 has an opening 184 at station 180. The carousel pivot arm is movable to a lowered position at servicing station 180, passing through opening 184 in building 182 externally of the building to external servicing location 180 for servicing of the transport pivot arm. The arm is movable to an upward position at servicing station 180 remaining within building 182 and bypassing external servicing location 180 and instead passing within building 182 to the next station therein upon rotation of hub 30. Building 182 has an external recess 186 formed therein at servicing station 180 providing the external location for servicing of the pivot arm. Thus, when servicing is desired, the pivot arm is swung downwardly through opening 184 to permit servicing, and then pivoted back upwardly through opening 184 when the servicing is completed. This allows servicing of the pivot arm externally of the building, which is desirable because the servicing technician can remain outside the building and not have to work in the elevated temperatures within the building. When servicing is not desired, the pivot arm merely remains in its upward pivoted position at station 180 without passing through opening 184.

Figure 19:
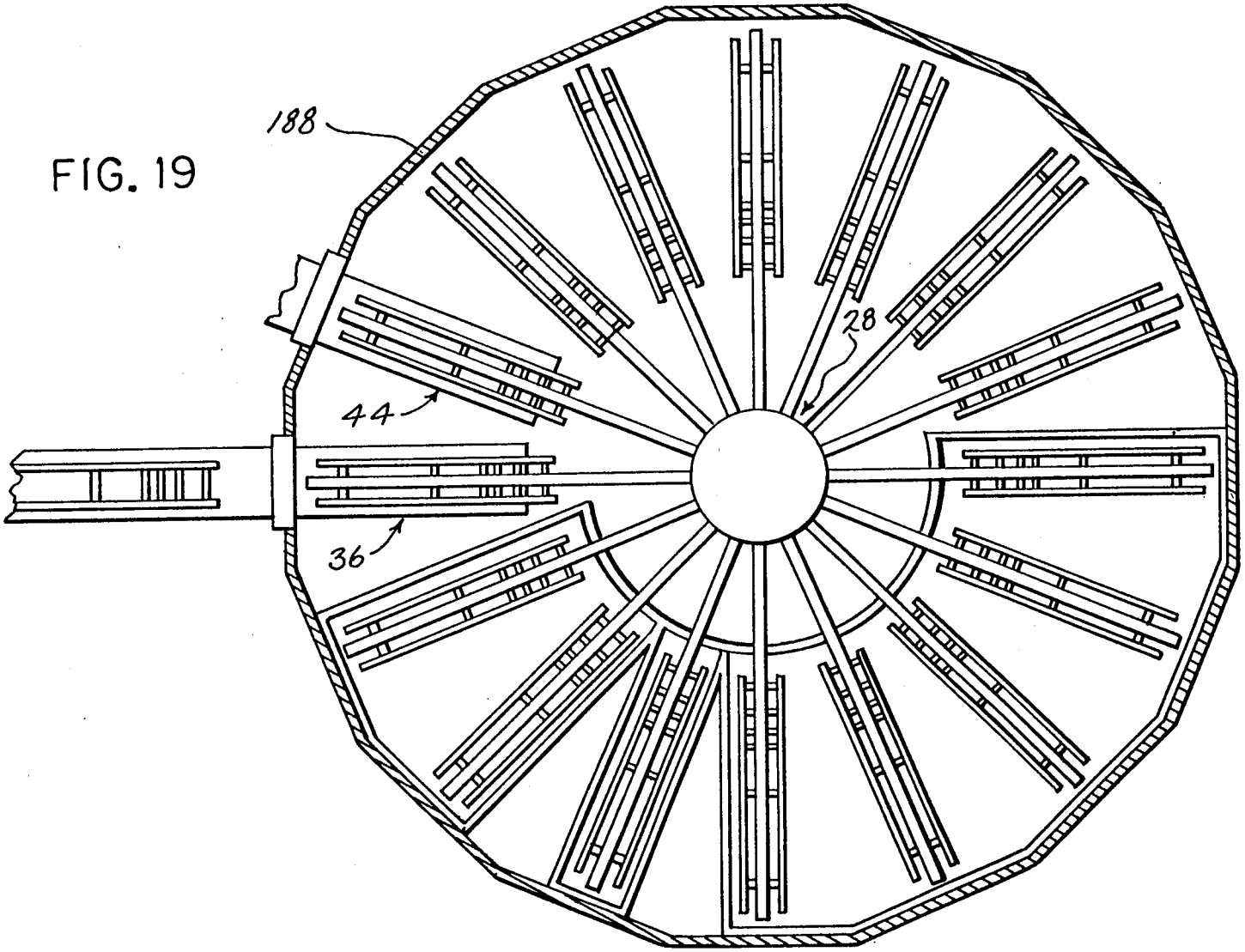
FIG. 19 is a top view of another embodiment of a manufacturing facility constructed in accordance with the invention.

FIG. 19 shows another embodiment, and like reference numerals are used from the above FIGS. where appropriate to facilitate clarity. Building 188 has an increased number of stations which may provide various desired combinations of preheat washing, rinsing, coating, and dripping between loading station 36 and unloading station 44. The carousel at the core of the building is supported independently of the building, and may be moved to different locations and buildings as desired.

Numerous alternatives are possible. For example, instead of conveying the frames to the loading station with a conveyor, other conveyance mechanisms may be used, such as a cart, a shuttle, loading from beneath rather than through a sidewall opening, etc. While plural transport pivot arm assemblies are shown, single arm assemblies may of course be used. A facility with a single station in the building may also be used, to provide only coating within the building, and to provide loading and unloading externally of the building, as well as preheating if desired. The facilities and methods disclosed may also be used in cold coating processes. In further embodiments, the motor drive for the hub may be provided at the hub within the building, or may be provided externally of the building with an outer ring for mechanical advantage enabling a smaller motor and saving the motor from the harsh environment and elevated temperatures within the building. While a single frame per pivot arm of the carousel is shown, each arm may carry and dip more than one frame at a time. For example, one frame may be carried above the arm, and another frame below the arm. Further alternatively, multiple frames may be stacked, and carried by an arm.

It is recognized that various equivalents, alternatives and modifications are possible within the scope of the appended claims.

I claim:

1. A manufacturing method for applying a coating to vehicle structural frames, each frame being a generally flat longitudinal member and of a size extending substantially the length and width of a vehicle and supporting the vehicle, the frame having a height, a width substantially greater than said height, and a longitudinal extent of a length substantially greater than said width, comprising transporting said vehicle structural frame through a coating station and coating said frame in a position such that said longitudinal extent of said vehicle structural frame is substantially horizontal, and raising said vehicle structural frame to a tilted position such that said longitudinal extent of said vehicle structural frame is tilted at an angle relative to horizontal.

2. A manufacturing method for applying a coating to vehicle structural frames, each frame being a generally flat longitudinal member and of a size extending substantially the length and width of a vehicle and supporting the vehicle, the frame having a height, a width substantially greater than said height, and a longitudinal extend of a length substantially greater than said width, comprising transporting said vehicle structural frame through a coating station into and out of contact with a coating liquid, and transporting said vehicle structural frame to a drip station allowing uncoated excess liquid to drip from said vehicle structural frame, and adjusting the drip angle of said vehicle structural frame at said drip station, wherein said drip angle is the angle between horizontal and said longitudinal extent of said vehicle structural frame along said length, providing a tank containing coating liquid at said coating station, providing an arm carrying said vehicle structural frame, and lowering said arm to lower said vehicle structural frame into said tank such that said frame is in a generally horizontal position.

3. The invention according to claim 2 comprising swinging said arm in an arc about a pivot point to lower and raise said vehicle structural frame into and out of said tank at said coating station, and to adjust said drip angle at said drip station.

4. The invention according to claim 3 comprising pivoting said arm at said pivot point to a vertically stationary central rotary hub rotatable about a vertical axis, peripherally spacing said coating station and said drip station around said hub, and rotating said hub to move said arm from said coating station to said drip station.

5. A manufacturing method substantially reducing space requirements for applying a coating to vehicle structural frames, each frame being a generally flat longitudinal member and of a size extending substantially the length and width of a vehicle and supporting the vehicle, the frame having a height, a width substantially greater than said height, and a longitudinal extent of a length substantially greater than said width, comprising:

providing a rotary carousel having a central hub rotatable about a vertical axis and having at least one arm thereon;

providing a loading station, a coating station having coating liquid, and an unloading station spaced peripherally around said hub;

rotating said hub to move said arm to said loading station;

attaching said vehicle structural frame to said arm at said loading station;

further rotating said hub to move said arm to said coating station and coating said vehicle structural frame;

further rotating said hub to move said arm to said unloading station;

detaching said vehicle structural frame from said arm at said unloading station;

rotating said hub to move said arm back to said loading station, to repeat the cycle;

providing a tank containing said coating liquid at said coating station, and moving said arm downwardly at said coating station to lower said vehicle structural frame into said coating liquid in said tank, and moving said arm upwardly at said coating station to raise said vehicle structural frame out of said coating liquid in said tank;

moving said arm downwardly at said loading station to engage said vehicle structural frame, and moving said arm upwardly at said loading station to lift said vehicle structural frame and carry said vehicle structural frame during said rotating of said hub, and moving said arm downwardly at said unloading station to disengage said vehicle structural frame, and moving said arm upwardly at said unloading station and rotating said hub to move said arm to said loading station, to repeat the cycle;

moving said arm relative to said hub, lowering said arm at said coating station to lower said vehicle structural frame into said tank such that said vehicle structural frame is in a generally horizontal position in said tank.

6. The invention according to claim 5 comprising attaching said vehicle structural frame in a generally horizontal position at said loading station to said arm.

7. The invention according to claim 6 comprising detaching said vehicle structural frame at said unloading station in a generally horizontal position from said arm.

8. The invention according to claim 23 comprising providing a cam track extending at least partially peripherally around said hub, engaging said arm with said cam track and moving said arm along said cam track during rotation of said hub such that said arm is lowered and raised according to the camming profile of said cam track.

9. A manufacturing method substantially reducing space requirements for applying a coating to vehicle structural frames, each frame being a generally flat longitudinal member and of a size extending substantially the length and width of a vehicle and supporting the vehicle, the frame having a height, a width substantially greater than said height, and a longitudinal extent of a length substantially greater than said width, comprising:

providing a building;

providing a rotary carousel in said building and having at least one arm thereon;

providing a loading station, a coating station with coating liquid, and an unloading station in said building peripherally spaced around said hub;

rotating said hub to move said arm to said loading station;

attaching said vehicle structural frame to said arm at said loading station;

further rotating said hub to move said arm to said coating station and coating said vehicle structural frame;

further rotating said arm to said unloading station;

detaching said vehicle structural frame from said arm at said unloading station;

further rotating said arm to said loading station, to repeat the cycle;

providing a servicing station spaced along the periphery of said hub;

providing an opening in said building at said servicing station;

moving said arm to a first position at said servicing station by passing said arm through said opening in said building and externally of said building to an external servicing location when servicing of said arm is desired.

10. The invention according to claim 9 comprising maintaining said arm at a second position at said servicing station with said arm remaining within said building and not passing through said opening in said building, such that said arm bypasses said external servicing location and instead passes within said building to the next station therein upon rotation of said hub.

11. The invention according to claim 10 comprising swinging said arm in an arc about a pivot point at said hub, such that said arm swings downwardly at said servicing station through said opening in said building and externally of said building for servicing of said arm, and swinging said arm upwardly after said servicing back through said opening and into said building.

* * * * *

UNITED STATES PATENT AND TRADEMARK OFFICE

CERTIFICATE OF CORRECTION

PATENT NO. : 5,194,302

DATED : March 16, 1993

INVENTOR(S) : PHILLIP C. RUEHL

It is certified that error appears in the above-identified patent and that said Letters Patent is hereby corrected as shown below:

Claim 2, Col. 7, Line 66, delete "extend" and substitute therefor -- extent --; Claim 8, Col. 9, Line 15, delete "23" and substitute therefor -- 5 --; Claim 9, Col. 9, Line 33, after "having" insert -- a central hub rotatable about a vertical axis and having --.

Signed and Sealed this

Fourteenth Day of December, 1993

*Attest:*

Bruce Lehman

BRUCE LEHMAN

*Attesting Officer*

*Commissioner of Patents and Trademarks*